US005295373A

United States Patent [19]

Lim et al.

[11] Patent Number: 5,295,373

[45] Date of Patent: Mar. 22, 1994

[54] WASHING MACHINE WITH A BUBBLE GENERATOR

[75] Inventors: Moo-Seang Lim, Seoul; Seung-Ki Min, Inchon; Soon-Chur Se; Hae-Sang You, both of Inchon; Jang-Sub Han, Seoul, all of Rep. of Korea

[73] Assignee: Daewood Electronics Co., Ltd., Seoul, Rep. of Korea

[21] Appl. No.: 53,014

[22] Filed: Apr. 27, 1993

Related U.S. Application Data

[62] Division of Ser. No. 785,546, Oct. 31, 1991.

[30] Foreign Application Priority Data

Jan. 12, 1991 [KR] Rep. of Korea ..... 91-409
Aug. 14, 1991 [KR] Rep. of Korea ..... 91-14066

[51] Int. Cl.[5] ..... D06F 17/12

[52] U.S. Cl. ..... 68/12.05; 68/183; 68/133

[58] Field of Search ..... 68/183, 207, 134, 12.02, 68/12.05, 133; 134/102.1, 102.2, 184; 8/158, 159

[56] References Cited

U.S. PATENT DOCUMENTS

| | | | |
|---|---|---|---|
| 1,528,180 | 3/1925 | Ball | 68/183 |
| 2,270,805 | 1/1942 | Evans | 68/183 X |
| 2,750,950 | 6/1956 | Inman et al. | 134/102 |
| 3,799,179 | 3/1974 | Thomas | 134/102 X |

FOREIGN PATENT DOCUMENTS

| | | | |
|---|---|---|---|
| 2907562 | 8/1980 | Fed. Rep. of Germany | 68/183 |
| 60-55996 | 4/1985 | Japan | 68/183 |
| 405601 | 3/1974 | U.S.S.R. | 68/183 |
| 706470 | 12/1979 | U.S.S.R. | 68/183 |

*Primary Examiner*—Frankie L. Stinson
*Attorney, Agent, or Firm*—James D. Hall; Thomas J. Dodd

[57] ABSTRACT

Disclosed herein is a washing machine which comprises a bubble generator operable to supply a predetermined amount of air bubbles into the washer tub in a batchwise manner at such a time interval as to allow said amount of air bubbles supplied in a preceding batch to be substantially collapsed before a next supply of said air bubbles commences.

8 Claims, 12 Drawing Sheets

WASHING MACHINE WITH A BUBBLE GENERATOR

This is a division of Ser. No. 07/785,546, filed Oct. 31, 1991 which is still pending.

FIELD OF THE INVENTION

The present invention relates to a washing machine; and, particularly, to an improved washing machine which is designed to supply a predetermined amount of air bubbles into the washer in a time controlled cycle so that the laundry articles therein are cleaned with a higher degree of detergency for a shortened period of washing time.

DESCRIPTION OF THE PRIOR ART

Generally, there are two categories of washing machines which are in practical use for the purpose of washing laundry articles such as clothes. A first category involves a vortex-type washer wherein laundry articles are subjected to a washing action as a pulsator therein rotates to generate a vortex flow within the washer tube. Such a vortex type washer may encompass, in a broad sense, a stirrer-type washer wherein laundry articles are made to undergo a vigorous frictional movement in the washing fluid by means of a bladed stirrer. A second category involves a drum-type washer having a horizontal rotary drum partially submerged in the laundering water. With this type of washer, the laundry articles contained in the rotary drum are rubbed with each other as the drum rotates about its horizontal axis.

These prior art washers have proven to be poor in their overall cleaning efficiency, mainly because they are not able to dissolve the detergent efficiently, nor can they apply a sufficient intensity of physical force to the laundry articles. Although it may be possible for the vortex-type washer to enhance the cleaning efficiency by way of further increasing the rotational speed of the pulsator or stirrer and thereby creating a more intensive vortex in the washer tub, this would give rise to another disadvantage that the laundry articles tend to suffer a severe damage as the washing operation continues. With a view to removing the deficiencies encountered in these washers, there have been proposed a variety of "bubble washers" that make use of air bubbles.

Japanese Patent Laid-open Publication No. Sho 62-189089 discloses a washer which does not incorporate any pulsator; but, instead, comprises a bubble generator and an ultrasonic oscillator. With this washer, cleaning operation is effectuated in a rather static manner by virtue of a combined action of the air bubbles and the ultrasound, making it possible to reduce the level of operational noises. However, this type of washer has been found unsuitable ±or practical use because it fails to clean the laundry articles with an acceptable degree of detergency.

Japanese Patent Laid-open publication No. Hei 2-60694 teaches a washer designed to improve the rinsing efficiency by way of feeding air bubbles into the washer tub during the rinsing process. This washer fails to use the air bubbles in the washing process, nor does it suggest a method of using the air bubbles in the washing process.

Japanese Patent Laid-open Publication No. Sho 63-139597 involves a washer wherein a small amount of washing fluid is continuously drained from the washer tub and then fed back to the washer tub together with a volume of air. The travelling air entrained in the return stream is converted into air bubbles as it penetrates through the washing fluid in the washer tub. In this way, the washer tub is continuously supplied with a substantial amount of air bubbles during the course of washing operation. However, such bubble feeding technique has been found disadvantageous because it tends to produce and then sustain an unwanted bubble barrier between the laundry articles and the washing fluid. The bubble barrier may hinder the laundry articles from being brought into contact with the washing fluid and, as a result, reduce the cleaning efficiency.

Japanese Patent Laid-open Publication No. Hei 2-60693 offers a washer wherein the amount of air bubbles varies in proportion to the quantity of laundry articles. The purpose of supplying varied amounts of air bubbles in this washer is to prevent the laundry articles from sinking down to the pulsator and suffering damages caused by the pulsator blades during washing. Supplying the air bubbles in an amount proportionate to the quantity of laundry articles, however, may result in excess bubbles flowing over the washer tub, which in turn may hamper the washing operation.

Japanese Patent Laid-open Publication No. Hei 2-60692 describes a washer of the type comprising a conventional pulsator rotatable in a forward or reverse direction with a fixed pause period and a bubble generator for feeding a bulk of air bubbles at the moment when the pulsator ceases to rotate. While successful in feeding the air bubbles with a reduced loss, this washer suffers from the deficiency that the interval between two bubble supplies is too short to allow the preceding bulk of air bubbles to be substantially collapsed or extinguished before the next supply thereof. As a result, the air bubbles supplied at such short time intervals will create bubble barriers on the surface of laundry articles, which may markedly decrease the effective contact area between the washing fluid and the laundry articles. Such a decrease in the contact area often leads to a reduced surface activity on the laundry articles and hence to a lowered cleaning efficiency.

SUMMARY OF THE INVENTION

Accordingly, it is an object of the present invention to provide an improved washing machine which substantially eliminates those disadvantages inherent in the prior art washers, and hence is capable of washing laundry articles with a higher degree of detergency for a shortened time period.

A further object of the invention is to provide a control device for the washing machine which enables a bubble generator to feed an optimal amount of air bubbles in a batchwise manner in such a time controlled cycle that said amount of air bubbles supplied in a given batch is substantially collapsed before a next supply of said amount of air bubbles commences.

In accordance with the invention, there is provided a washing machine which comprises: a washer tub capable of containing a level of washing fluid; a pulsator rotatably mounted on the bottom of said washer tub for creating a vortex flow within said washer tub; means for causing said pulsator to rotate in a forward or reverse direction; and means for feeding a predetermined amount of air bubbles into said washer tub in a batchwise manner at such a time interval as to allow said amount of air bubbles supplied in a given batch to be substantially collapsed before a next supply of said amount of air bubbles commences.

BRIEF DESCRIPTION OF THE DRAWINGS

The above and other objects and features of the present invention will become apparent from the following description and the accompanying drawings wherein like reference numerals refer to like parts in different views.

DETAILED DESCRIPTION OF THE PREFERRED EMBODIMENTS

Figure 1:
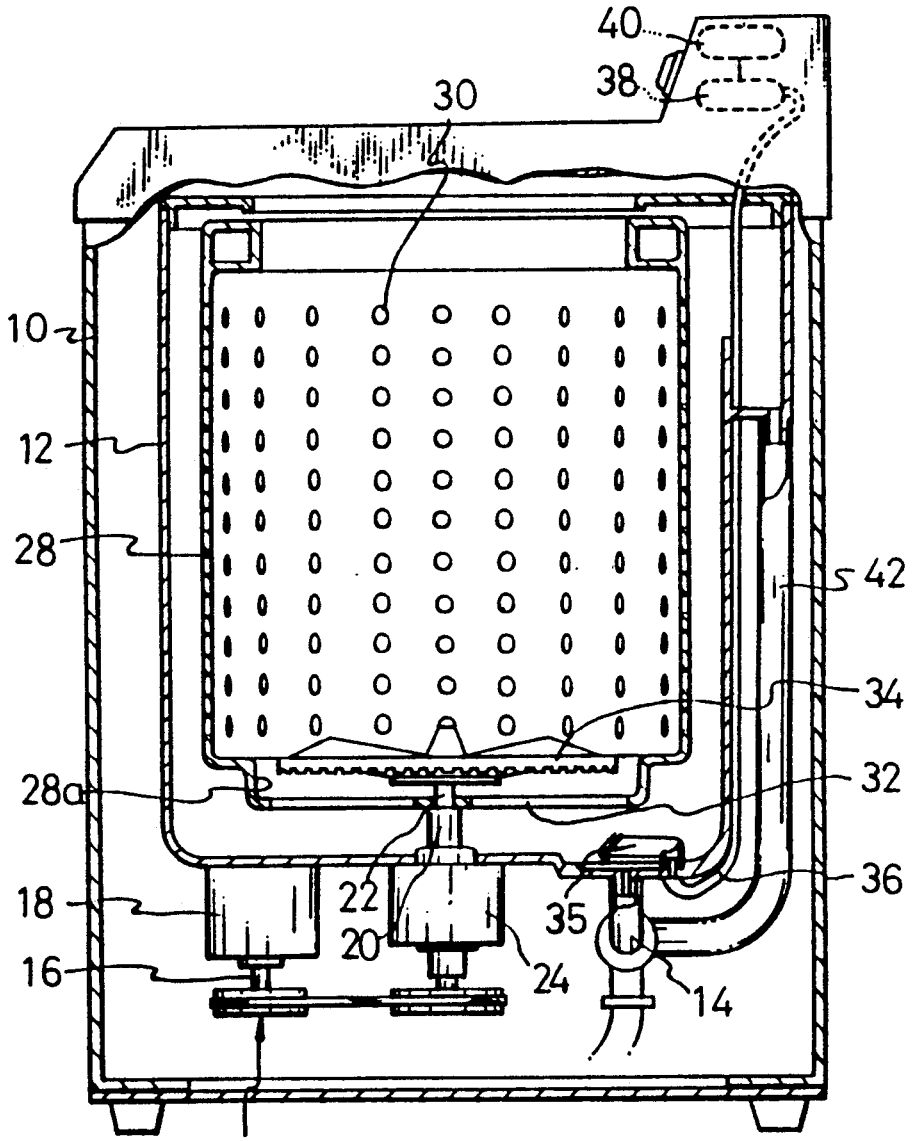
FIG. 1 is a schematic sectional view showing an overall construction of a vortex-type washing machine in accordance with the present invention.

Referring now to FIG. 1, there is shown by way of example a vortex-type washing machine in accordance with the present invention. The washing machine comprises a housing 10 and stationary washer tub 12 fixedly mounted within the housing 10 for containing therein a level of washing fluid or detergent solution. Connected to the bottom of the stationary tub 12 is a drain pipe that occasionally allows the washing fluid to flow out of the stationary tub 12 during the washing, dewatering and rinsing operations. The washing machine further includes an electric motor 18 having a drive shaft 16 and a clutch assembly 24 having a first and a second driven shafts 20 and 22. As shown, the electric motor 18 and the clutch assembly 24 are both secured to the stationary tub by means of suitable fastener means, e.g., welding or threading. The drive shaft 16 is operatively connected to the driven shafts 20 and 22 through a belt transmission mechanism 26, for instance. The clutch assembly 24 serves to selectively couple the driving force generated by the electric motor 18 with one of the first and the second driven shafts 20 and 22.

The first driven shaft 20 carries at Its top end a otatable washer tub 28 which is kept immovable during the process of washing operation but is caused to rotate at a high speed during the dewatering process. The rotatable tub 28 is provided with, at its side wall, a plurality of washing fluid communication holes 30 permitting the washing fluid to flow into or out of the rotatable tub 28 and, at its bottom wall, a bubble passage 32 through which air bubbles may penetrate into the rotatable tub 28, as further set forth below.

Rotatably mounted on the bottom surface of the rotatable tub 28 is a pulsator 34 carried by the second driven shaft 22. The pulsator 34 is rotatable in a forward or reverse direction to create a vortex flow within the rotatable tub 28, the structural details of which will be discussed below with reference to FIG. 4.

A bubble generator 35 is located on the bottom surface of the stationary tub 12 in order to generate a volume of air bubbles which will in turn penetrate into the rotatable tub 28 through the bubble passage 32. The bubble generator 35 communicates through an air conduit 36 with an air pump 38 which serves to create a volume of pressurized air under a precise control of a control device 40. An overflow pipe 42 is provided outside the stationary tub 12 to gather and then bypass the washing fluid and/or foams which may flow over ±he stationary tub 12 in the course of washing or dewatering operation.

Figure 2:
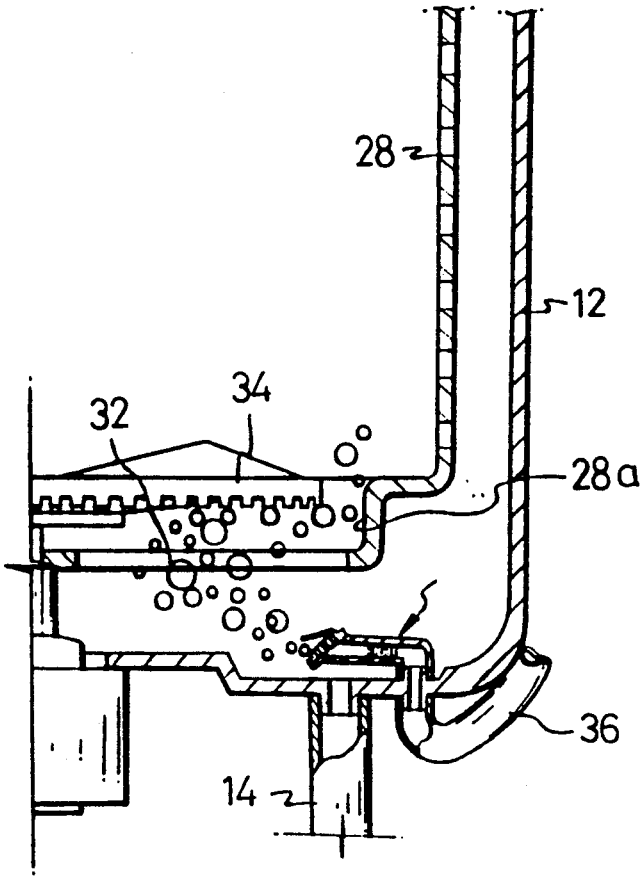
FIG. 2 is an enlarged view of the washing machine shown in FIG. 1, illustrating the positional relationship of the bubble generator with respect to the rotatable washer tub and the drain pipe.

Turning to FIG. 2, there is shown in detail the positional relationship of the bubble generator 35 with respect to the rotatable tub 28 and the drain pipe 14. As shown, the bubble generator 35 is positioned on the bottom surface of the stationary tub 12 so as to emit or shoot the air bubbles toward the bubble passage 32 of the rotatable tub 28. This will enable the air bubbles to penetrate into the rotatable tub 28 with little loss. Moreover, the location of the bubble generator 35 immediately above the drain pipe 14 facilitates movement of the fluid contained in the bubble generator 35, during the draining process, into the drain pipe 14.

Figure 3A:
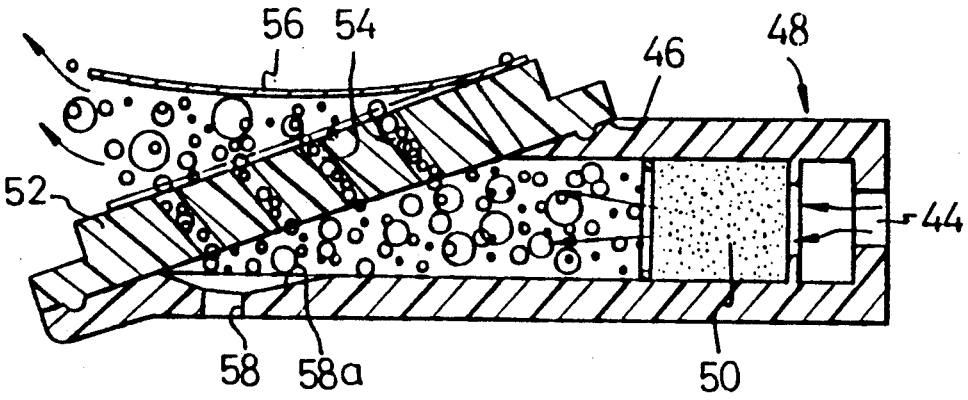
FIGS. 3A and 3B are, respectively, cross sectional and perspective views showing an embodiment of the bubble generator in accordance with the present invention.

FIGS. 3A and 38 illustrate a preferred embodiment of the bubble generator 35 which is applicable to the washing machine of FIG. 1. This bubble generator 35 comprises a casing 48 having an inlet port 44 connectable to the air pump represented as 08 in FIG. 1 and an inclined outlet port 46 opposite the inlet port 44 Inserted within the casing 48 is a porous member 50 made of, e.g., sponge. The porous member 50 provides an interface at which the pressurized air from the air pump meets the washing fluid. The pressurized air will be broken to a plethora of fine bubbles as i±passes through the porous member 50. A bubble orientation plate 52 having a number of through holes 54 is rigidly attached to the outlet port 46 at such an inclined angle that the air bubbles created in the bubble generator 35 can be directed toward the bubble passage 32 of the rotatable tub 28 as clearly shown in FIG. 2.

It is preferable that an elastic flap 56 of sufficient flexibility be secured to the upper margin of the bubble rientation plate 52. The elastic flap 56 normally assumes a first position shown in a phantom line in FIG. 3A to close off the through-holes 54 of the bubble orientation plate 52. When the bubble generator 35 begins to operate, the elastic flap 56 will flex to a second position shown in a solid line in FIG. 3A, allowing the air bubbles to be emitted from the bubble generator 35. Thus, the elastic flap 56 functions to prevent any foreign materials, released from the laundry articles during the washing operation, from infiltrating into the bubble generator 35 or clogging the through-holes 54, which would otherwise lead to a premature failure of the bubble generator 35. In addition, the casing 48 is provided with at its bottom wall a drain port 58 that facilitates removal of the residual fluid contained in the casing 48 whenever the washing fluid is drained through the drain pipe in the draining process. The drain port 58 of the casing 48 terminates at its top slant surface 58*a* which is configured to make the residual fluid flow toward the drain port 58.

Figure 4:
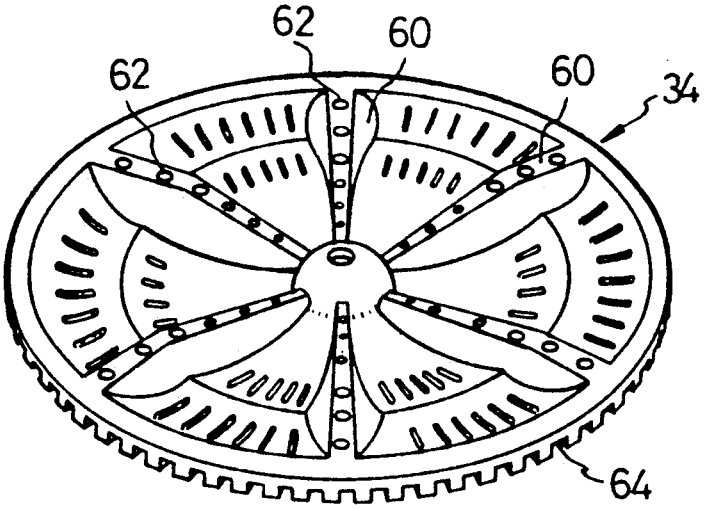
FIG. 4 is a perspective view of the pulsator that may be advantageously utilized in the present invention.

Referring to FIG. 4, there is shown a pulsator 34 which may be advantageously employed in the present invention. The pulsator 34 has a plurality of radial ribs or blades 60 for causing a vortex flow within the rotatable tub 28. Each of the ribs 60 is provided with an array of axial holes 62 pierced through the thickness of the pulsator 34.

Figure 5:
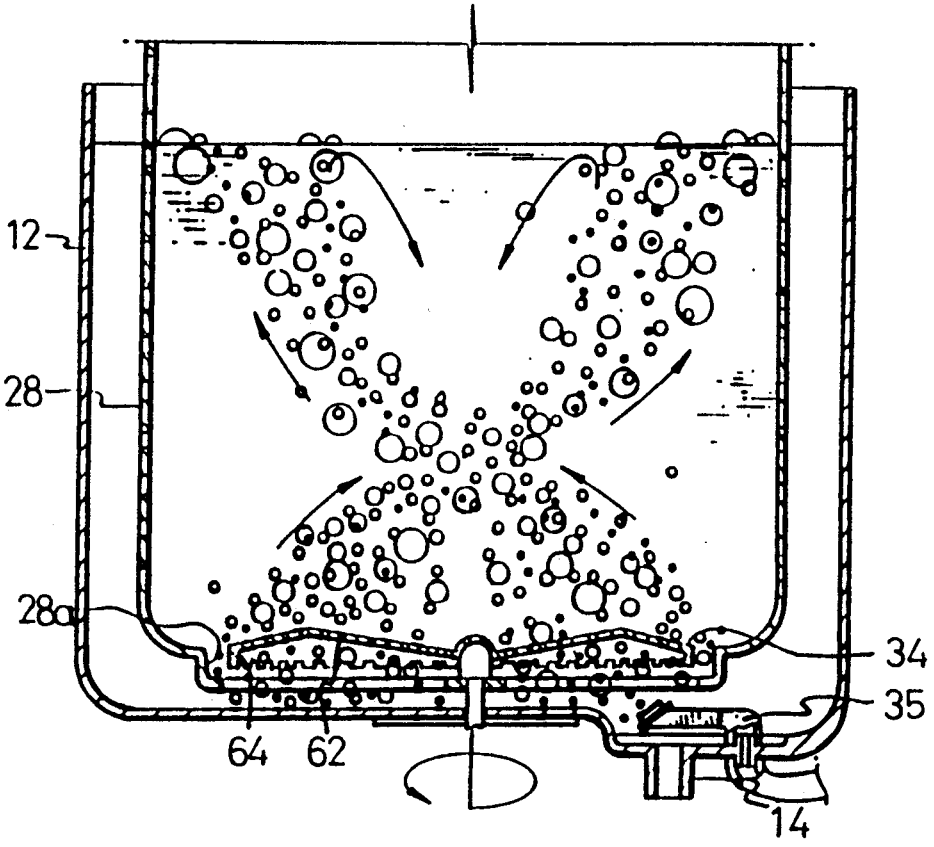
FIG. 5 shows a travelling path of air bubbles in a preferred embodiment of the present invention, with a portion of the washing machine removed for clarity.

The axial holes 62 serve to pass a part of the air bubbles to the upper space of the rotatable tub 28, especially when the pulsator is in its cease period. Apart from the axial holes 62, there is provided on the peripheral underside of the pulsator 34 a multiplicity of equally spaced radial grooves 64 through which the remaining part of the air bubbles rises up toward the upper space of the rotatable tub 28. As best shown in FIG. 5, the pulsator 34 of the above shape and configuration makes it possible to feed the air bubbles into the rotatable tub 28 in a highly uniform condition. Particularly, most of the air bubbles passing through the radial grooves 64 come into collision with a bubble impinging surface 28*a* and then travels upward in an inclined direction. This maximizes the amount of air bubbles coming into contact with the laundry articles contained in the rotatable tub 28.

It is of importance to note that the air bubbles in the instant invention should be fed to the rotatable tub 28 in a batchwise manner, and not continuously, at such a time interval that most of the previously supplied air bubbles are collapsed or extinguished by themselves or under the influence of ±he vortex flow. The time interval is controlled by means of a control device which will be further described with reference to FIGS. 8 to 13. While a specific device for supplying air bubbles into the rotatable tub has been disclosed hereinabove, the invention is not limited thereto and many changes may be made without deteriorating the bubble supply efficiency. For example, it may well be possible to provide a bubble passage along the shaft of the pulsator 34.

Figure 6:
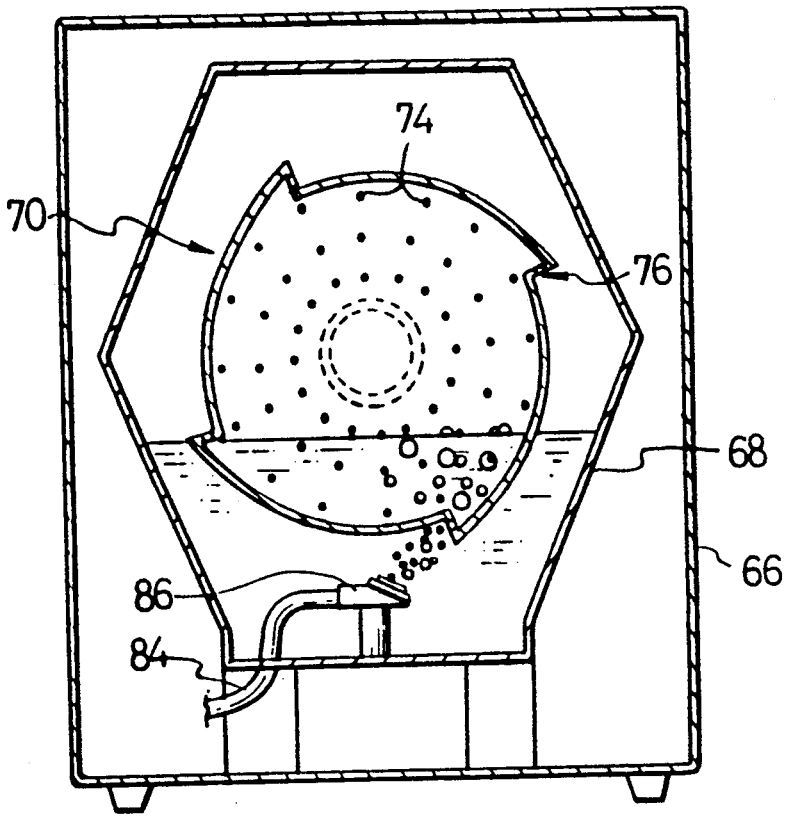
FIG. 6 is a schematic view showing an improved drum-type washing machine in accordance with the present invention.

As is apparent from FIG. 6, the present invention can equally be applied to a drum-type washing machine. This type of washing machine normally comprises a housing 66 and a stationary tub 68 encased within the housing 66 for containing a level of washing fluid. Horizontally mounted on the stationary tub 68 is a rotary drum 70 capable of accommodating laundry articles therein, the lower portion of the rotary drum 70 being submerged under the washing fluid. The rotary drum 70 has a multiplicity of through-holes 74 which are distributed in a substantially uniform pattern to allow the washing fluid to flow into or out of the drum.

Figure 7:
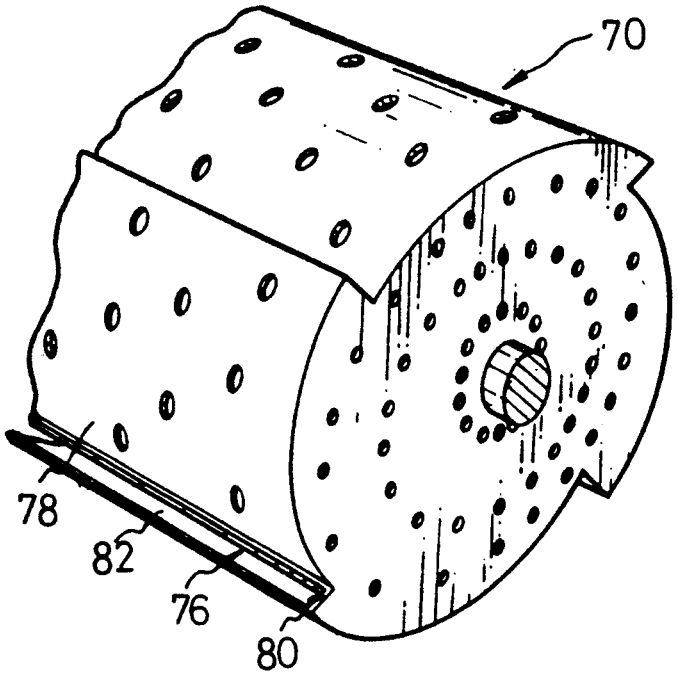
FIG. 7 is an enlarged perspective view of a rotary drum applicable to the washing machine of FIG. 6.

As depicted in FIG. 7, the rotary drum 70 includes four axially extending notches 76 that are spaced apart from one another along the circumference of the drum. Each of the axial notches 76 has a curved leading surface 78 and a flat trailing surface 80 substantially perpendicular to the leading surface 78. Formed on the trailing surface 80 is an axial slot 82, the width of which is large enough to smoothly pass the air bubbles therethrough.

Figure 3B:
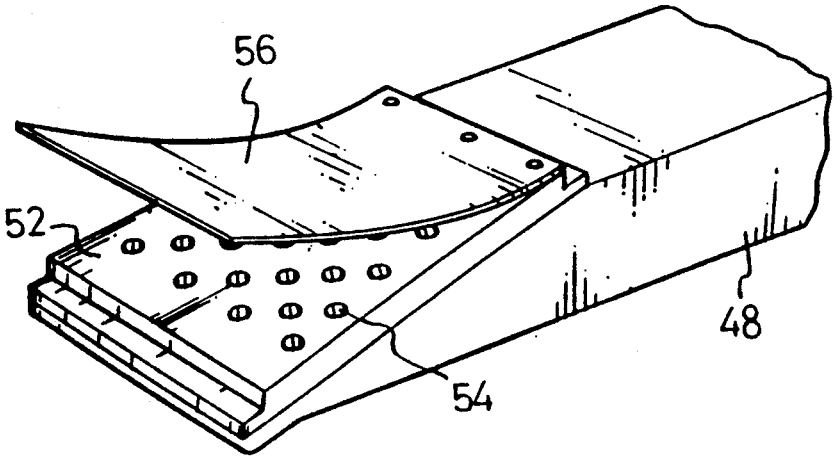

Turning back to FIG. 6, the bubble generator 86 is positioned on the bottom of the stationary tub 68 and communicates with an air pump(not shown) through a conduit 84. It should be appreciated that the bubble generator 86 operates intermittently to feed a predetermined amount of air bubbles into the rotary drum in a periodic batchwise manner. The amount and the supply interval of the air bubbles are controlled by means of a control device which will be described below. Although the bubble generator shown in FIG. 3 can also be applied to the drum-type washing machine with no or little structural changes, other bubble generators may equally be used for the bubble supply purpose. In order to maximize the efficiency of air bubble infiltration in±o the rotary drum 70 through the axial slots 82 thereof, the bubble generator 86 is so oriented as to emit or shoot the air bubbles toward the axial slots in a counter clockwise direction. This will prevent the air bubbles shot by the bubble generator 86 from failing to penetrate into the rotary drum and thereby flowing around the rotary drum at ±he mercy of the clockwise liquid stream.

FIG. 8 is a schematic diagram of a control device of a preferred embodiment employing the invention. The control device 100 comprises a switch pad 91, detection means 92, a microprocessor 90, a load drive circuit 93 and an air pump drive circuit 94. As shown in FIG. 8, the switch pad 91 and the detection means 92 are connected to the inputs of the microprocessor 90 and the load drive circuit 93 and the air pump drive circuit 94 are paired and connected to the outputs of the microprocessor 90.

The switch pad 91 includes a first switch station 91*a* and a second switch station 91*b* wherein the first switch station 91*a* may have a plurality of type selection switches which are used in advising the machine of the type of laundry articles to be washed, and the second switch station 91*b* may also have a plurality of level selection switches which enable the user to select a preset volume of washing fluid in the washer tub 12 and 28 as shown in FIG. 1. For the convenience of manipulation, each type selection switch in the first switch station 91*a* is provided with an indicium representing the type of laundry articles, e.g., "wool" or "cotton", and each level selection switch in the second switch station 91*b* is provided with an indicium representing the volume of washing fluid which may be devided by, e.g, three levels, i.e., "High", "Middle" and "Low". It is well known in the art that the switch pad 91 may also comprise other switch stations, e.g., a start switch station. When a type selection switch of the first switch station 91*a* and a level selection switch of the second switch station 91*b* are depressed by the user, a type signal indicative of the type of laundry articles and a level signal indicative of &he level of washing fluid are respectively issued to the microprocessor 90.

The detection means 92 comprises a load sensor 92*a* for detecting the weight of the specific type of laundry articles contained within the washer tub 28 shown in FIG. 1 and a level sensor 92*b* for sensing the volume of the washing fluid contained therein. The load sensor 92*a*, as well known in the art, detects the turning inertia of the washer tub 28 containing the laundry articles and issues a load signal indicative of the weight of laundry articles to the microprocessor 90. The level sensor 92b may be employed to determine whether or not the volume of the washing fluid provided to the washer tub through a feed valve(not shown) is equal to the volume selected by the second switch station 91b. For the control scheme, the detection means 92 may also include a photo sensor such as the one disclosed in U.S. Pat. No. 4,372,134.

The microprocessor 90, as shown in FIG. 8, may be of any type of microprocessor suitable for such control purpose, which has a storage region therein or a separate memory device. The storage region may contain a plurality of washing course programs stored in the form of instructions and data, as further described below. Each washing course program may be selected by the type and the level selection signal and the load signal from the load sensor 92a. The microprocessor 90 may execute and process a series of instructions and data in response to the selected washer control course to provide control signals to a load drive circuit 93 and an a i r pump drive circuit 94.

The load drive circuit 93 comprises a motor drive circuit 93a, a drain valve circuit 93b and a feed valve circuit 93c. The motor drive circuit 93a is responsive to a motor control signal from the microprocessor 90 to enable the motor to rotate the pulsator 34 and the washing tub 28 shown in FIG. 1. The drain valve circuit 93b is responsive to a drain valve control signal to turn on or off the drain valve(not shown) for displacing the washing fluid from the washer tub. The feed valve circuit 93c is responsive to a feed valve control signal to turn on or off the feed valve (not shown) for supplying a predetermined amount of washing fluid to the washer tub 12 and 28.

Figure 8A:
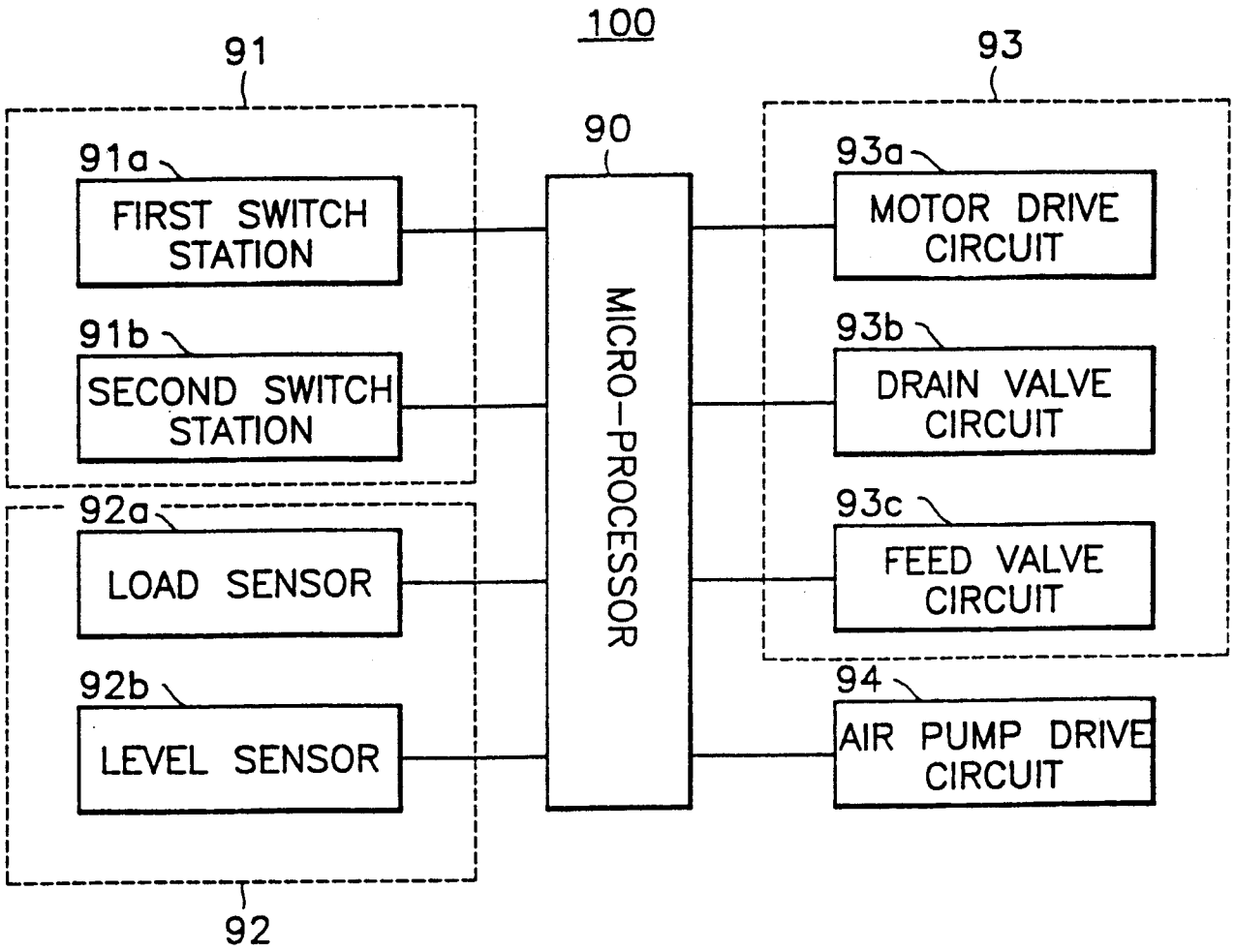
FIG. 8A is a schematic block diagram of a control device in accordance with the present invention, FIG. 8B being a detailed circuit diagram of an air pump drive circuit associated with the microprocessor.
Figure 8B:
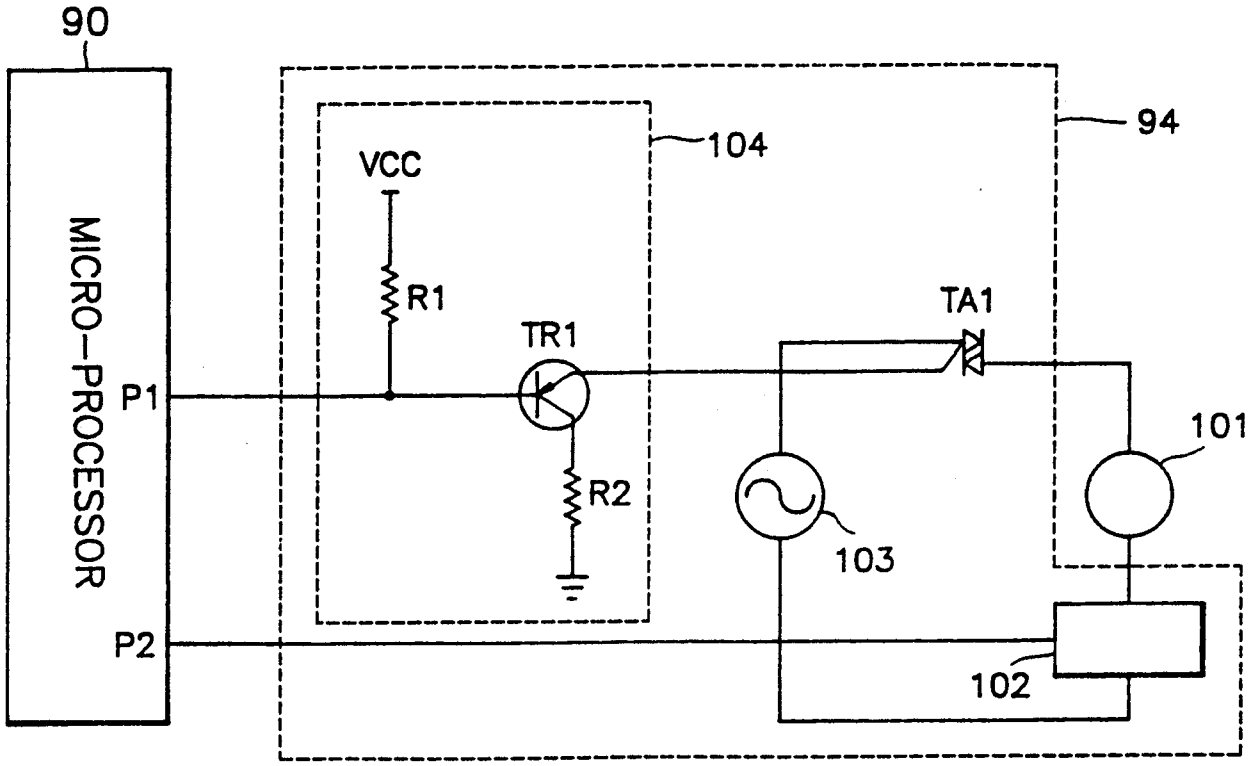

The air pump drive circuit 94 is responsive to the injection control signal from the microprocessor 90 to energize the air pump 101. In FIG. 8B, a detailed circuit diagram of the air pump drive circuit 94 is shown in association with the microprocessor 90. The details of the load drive circuit 93, the switch pad 91 and the detection means 92 are omit&ed here for the sake of convenience.

In FIG. 8B, the air pump drive circuit 94 comprises an 15 output control device 102 which is responsive to an output control signal from the microprocessor 90 to control the output power of the air pump 101; a triac TA1 which is adapted to connect the AC source 103 to the air pump 101 via the output control device 102; and a triac drive circuit 104 which is responsive to a triac control signal from the microprossor 90 to turn on or off the triac TA1. The triac drive circuit 104 comprises a transistor TR1 wherein the emitter of the transistor TR1 is connected to the gate of the triac TA1, its collector is connected through a resistor R1 to the earth, and its base is coupled with an output port Pi of the microprocessor 90. The base of the transistor TR1 is also linked to the DC source Vcc via a resistor R1. Referring to FIG. 8B, it may be readily understood by one skilled in the art that, with a constant output power of the air pump 101, the air pump drive may be controlled by providing a "High" level or "Low" level signal to the triac drive circuit 104 by turning on or off the triac TA1 to link or separate the AC power source 103 to or from the airpump 101.

Referring back to FIG. 8A, the control scheme of the washer is performed by the control circuit 100, which comprises a plurality of washing courses, each of which may be, as known in the art, selected based on the type and the weight of laundry articles and the volume of washing fluid; and involves three types of operating modes, i.e., washing mode, rinsing mode, and dewatering mode. That is, a given washing course may comprise: a washing mode having a predetermined time period; a rinsing mode having a preset number of operations; and a dewatering mode also having a preset number of operations. The rinsing mode and the dewatering mode may be alternately operable, and the predetermined time period and the preset number of operations may be selected for each specific washing course.

In the washing mode, when the washing fluid in the washer tub reaches a predetermined level, forward and reverse motor drive signals from the microprocessor 90 are sequentially sent to the motor drive circuit 93a. The motor(18 as shown in FIG. 1) is alternately energized by the motor drive circuit 93a to cause forward and reverse rotation of the pulsator 34, thus producing a water stream flowing in alternately opposite directions. The forward and reverse rotation of the pulsator 34 can be made, e.g., on succesive time intervals of 2 equal seconds. As the pulsator 34 is rotated, the detergent is dissolved in washing fluid and stains are removed from the laundry articles. In this manner, a washing mode is initiated and proceeded for a predetermined time period.

When the washing mode is completed, the output of the motor drive circuit 93a is interrupted, and a drain signal from the microprocessor 90 is given to the drain valve circuit 93b to open the drain valve so that the washing fluid is removed from the washer tub. The motor is rotated only in one direction while this dewatering mode of operation continues.

After the dewatering mode is ended, a rinsing mode with an influx of fresh water is performed. The rinsing mode is similar to the washing mode with the exception of the time interval of the operation and the fresh water fed into the washer tub. In a given washing course, the rinsing mode and the dewatering mode may be alternately performed for a predetermined number of times. As known in the art, such combined modes of operations for a specific washing course may be preprogrammed in the storage region of the microprocessor 90.

According to the present invention, for the washing mode in a given washing course, predetermined amounts of air bubbles may be intermittently provided to the washer tub through the air pump 101 under the control of the microprocessor 90. This is achieved by alternately providing an injection control signal for an injection time period and a collapsing control signal for a collapsing time period to the airpump drive circuit so as to energize and deenergize the air pump 101 during the injection and the collapsing time periods. Referring back to FIG. 8B, the injection control signal may be, e.g., a "H" level voltage signal, while the collapsing control signal may be a "L" level voltage signal.

As described below, supposing that the output power of the air pump 101 is fixed, the injection time period is determined so as to correspond to the predetermined amount of air bubbles which may be empirically obtained. Similarly, the collapsing time period, during which the entire amount of air bubbles introduced is substantially collapsed, ma be experimentally determined, which is normally equal to or greater than the injection time period.

The predetermined amount of air bubbles is equivalent to "the saturation bubble quantity" which is the maximum amount of air bubbles that may be kept, under the normal operating conditions, i.e., the amount of air bubbles before they begin to overflow, within the washer tub 28 containing a given load of laundry articles and a given level of washing fluid.

The present inventors have empirically discovered that the saturation bubble quantity y may be represented by the following formula:

$$y^*=\beta-\alpha x \quad \text{(Eq. 1)}$$

wherein x is the weight of laundry articles, $\beta$ denotes a reference bubble quantity and $\alpha$ represents a coefficient of the bubble supply.

The reference bubble quantity $\beta$ is a constant value corresponding to a given volume of washing fluid, which has been empirically found to approximately statisfy:

$$\beta=V\times 1/10 \quad \text{(Eq. 2)}$$

wherein V is the volume of washing fluid contained in the washer tub.

The bubble supply coefficient $\beta$ is also experimentally found to be within the range from 0.551/kg to 0.681/kg. The capacity of the washing machine is generally represented by the maximum weight of laundry articles which may be accommodated within the washer tub, whereas the maximum volume of washing fluid for the respective capacity of the washing machine is confined by the size of the washer tub thereof. Experimentally, the bubblesupply coefficient $\alpha$ may be determined to be, e.g., 0.5961/kg for a 5.2 kg washing machine, 0.6661/kg for a 6.6 kg washing machine and 0.6231/kg for a 7.5 kg washing machine, respectively.

Figure 9:
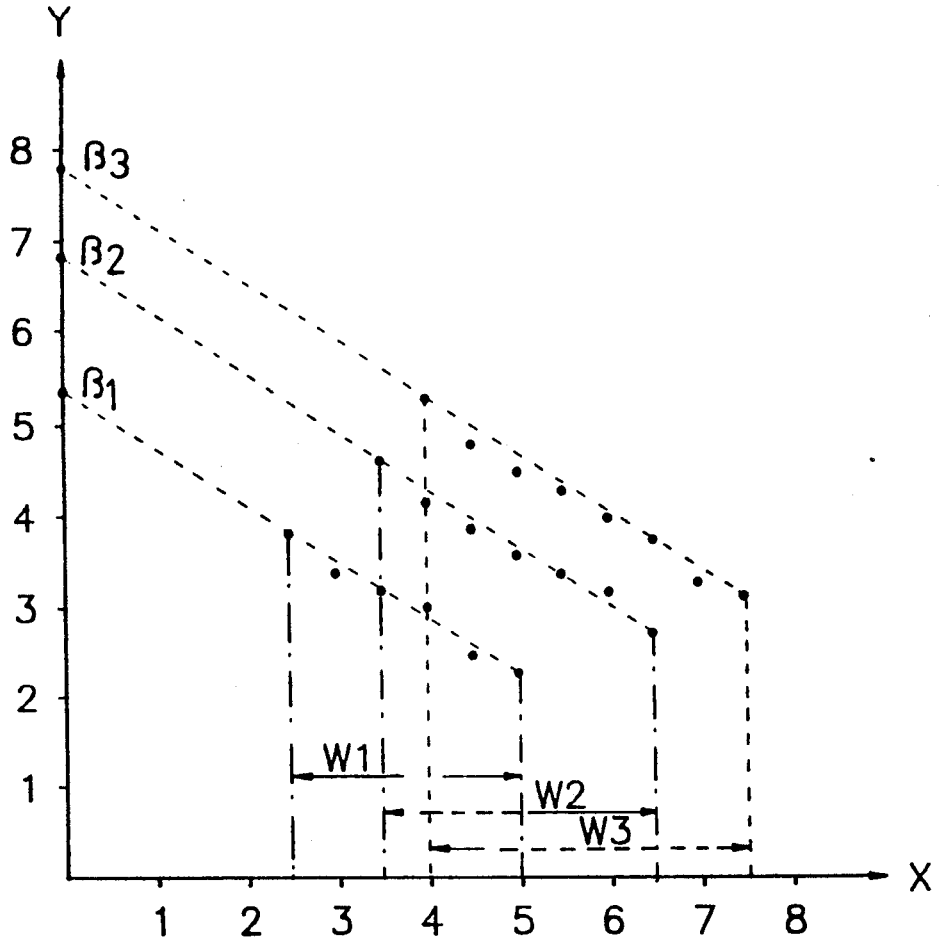
FIG. 9 is a graphical representation illustrating the relationship between the quantity of air bubbles and the wreight of laundry articles when the volume of washing fluid is fixed at A, B or C.

FIG. 9 depicts a graphical representation illustrating a relationshp between the quantity of air bubbles, y, and the weight of laundry articles, x, with the volume of washing fluid as a parameter(A, B and C) wherein $W_1$(e.g., 2.5–5.2 kg), $W_2$(e.g., 3.5–6.6 kg) and $W_3$(e.g., 4–7.5 kg) represent the working load range of laundry articles which can be preferably contained in, e.g., the respective 5.2 kg, 6.6 kg and 7.5 kg washing machines with the respective volume of washing fluid A(e.g., 541), B(e.g., 691) and C(e.g., 781). As shown in FIG. 9, for a given volume of washing fluid A, B or C, ±he saturated bubble quantity which is represented by the dots is negatively proportional to the weight of laundry articles, which can be closely approximated by Eq. 1 for the working load range of laundry articles in a given washing machine.

Now, assuming the volume of washing fluid is 541 and the weight of laundry articles is 5.2 kg, the saturated bubble quantity is $y^*=54\times 1/10(1)-0.5961/\text{kg}\times 5.2\ \text{kg}=2.31$.

As mentioned previously, the injection time period may be computed based on &he saturated bubble quantity obtained for a given air pump having a constant output power. That is, assuming the output power of the air pump is 38.3cc/sec, the injection time period is $2.31\div 38.3\ \text{cc/sec}\approx 60$ sec and the collapsing time period may be determined either empirically or by selecting a period identical to or slightly greater than the injection time period as described above.

Consequently, the injection and the collapsing time periods may vary with a given washing course which is selected based on the weight of laundry articles and the volume of washing fluid. It should also be understood that the injection and the collapsing time periods for a selected washing course may be computed using a computer program o±the microprocessor employing Eq. 1; or a set of data for the injection and the collapsing time periods compiled empirically may also be stored in the storage region of the microprocessor.

Table 1 summarizes exemplary data on the injection and the collapsing time periods, which are empirically obtained by way of conducting a washing mode operation comprising 6 cycles in three separate washing courses under the optimal condition using a 5.2 kg capacity washing machine.

TABLE 1

(unit: sec)

| Washing | Injection and Collapsing Time Periods | | | | | | | | | | | |
|---|---|---|---|---|---|---|---|---|---|---|---|---|
| Course | d | c | d | c | d | c | d | c | d | c | d | c |
| 1 | 70 | 70 | 50 | 50 | 60 | 60 | 60 | 60 | 60 | 60 | 60 | 60 |
| 2 | 50 | 70 | 50 | 70 | 50 | 70 | 50 | 70 | 50 | 70 | 50 | 70 |
| 3 | 40 | 40 | 20 | 20 | 30 | 30 | 30 | 30 | 30 | 30 | 30 | 30 |

(output power of the air pump: 38.3 cc/sec)
d: injection time period
c: collapsing time period In carrying out the first washing course to generate the data listed in Table 1, 5.2 kg of laundry articles is washed with 541 of washing fluid. Similarly, the second and the third washing courses are conducted with 3 kg and 1.5 kg laundry articles in 371 and 201 of washing fluid, respectively.

By repeating and covering various possible operation conditions, therefore, data bank for the injection and the collapsing time periods as a function of the weight of laundry articles and the volume of washing fluid is generated and can be stored in the memory region of the control circuit and accessed when an appropriate washing course is selected by the switch pad 91 and the detection means 92.

Figure 10:
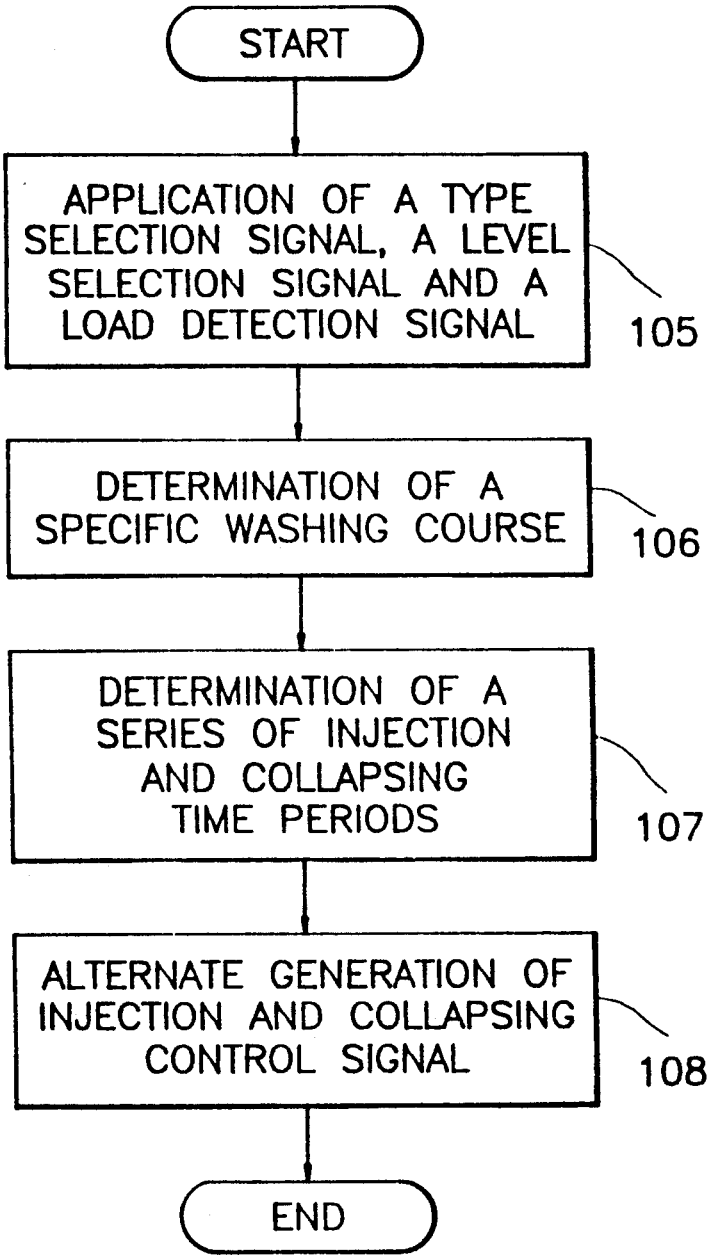
FIG. 10 is a flow chart showing the control sequence of the air pump associated with the control device of FIG. 8.

FIG. 10 is shown in flow chart of the air pump control performed by the microprocessor 90 depicted in FIG. 8. In step 105, when the switch pad 91 is depressed by the user and the weight of laundry articles is detected by the load sensor 92*a*, a type selection signal indicative of the type of laundry articles, a level selection signal indicative of the volume of washing fluid from the switch pad 91 and a load detection signal indicative of the weight of laundry articles from the load sensor 92*a* are applied to the microprocessor 90.

In step 106, the microprocessor 90, in response to the type selection signal, the level selection signal and the load detection signal, determines a specific washing course.

In step 107, the microprocessor 90 also determines a series of the injection and the collapsing time periods for the specific washing course.

In step 108, the microproccessor 90 alternately provides the air pump drive circuit 94 with the injection control signal for the injection time period and the collapsing control signal for the collapsing time period during the washing mode of operation preset in a specific washing course; and similarly provides the injection and the collapsing control signals to the air pump drive circuit 94 during the rinsing mode of operation thereof.

Description will now be given by way of the following examples to further illustrate the preferred features and advantages of the present invention.

EXAMPLE 1

Figure 11:
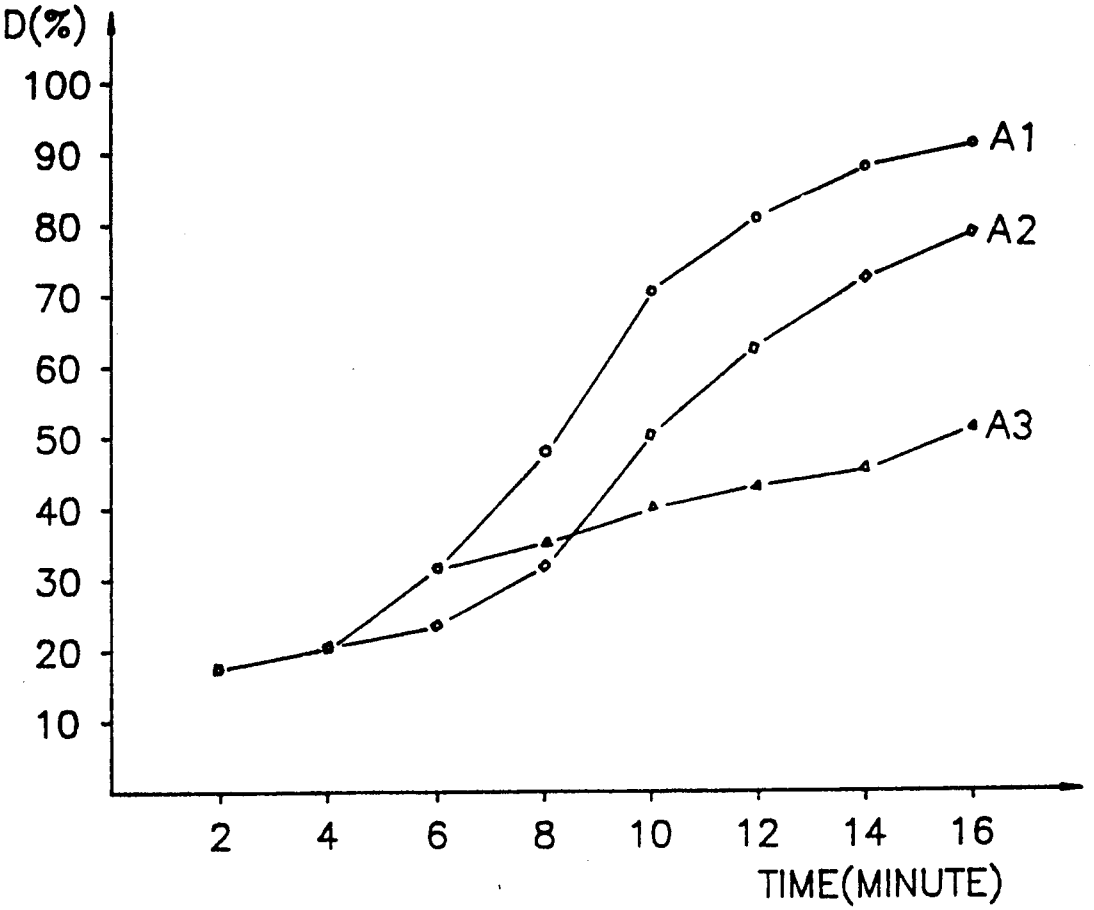
FIG. 11 graphically compares the cumulative degree of detergency achieved in accordance with the present invention against those of prior art washing machines.

Initially, 5.2 kg of dirty cotton towels together with 104 kg of a detergent formula were put into the washing tub of the improved washing machine of the present invention, containing therein 541 of water heated to about 30° C. The detergent was comprised of 20.8 g of lauric acid, 5.2 g of sodium carbonate, 52 g of sodium sulfide and 26 g of sodium tripolyphosphate. While the pulsator was in its normal operation, the air pump was energized for 60 seconds to feed 2.31 of air bubbles into the washing tub and then deenergized for another 60 seconds to allow the air bubbles to be collapsed virtually in their entirety. Such energizing deenergizing cycle of the air pump was repeatedly carried out for a time period of 16 minutes; and the degree of detergency, D, was measured at a time interval of 2 minutes and plotted to obtain curve A1 as shown in FIG. 11. The degree of detergency, D, was calculated as follows:

$$D = \frac{R_w - R_1}{R_o - R_1} \times 100(\%)$$

wherein $R_o$ is the reflective index of a clean reference towel, $R_1$ represents the pre-washing reflective index of a dirty towel and $R_w$ denotes the post-washing reflective index of the cleaned towel.

As is apparent from FIG. 11 , the present washing machine has the ability to wash the soiled laundry articles, to a higher degree of detergency(90) within a relatively short period of time(16 minutes). cl EXAMPLE 2

The same operation as in Example 1 above was carried out without any air bubbles fed into the washing tub. During the course of washing operation, the degree of detergency was measured at a time interval of 2 minutes and plotted to obtain curve A2 as illustrated in FIG. 11. The degree of detergency reached around 78% after 16 minutes of washing.

EXAMPLE 3

The same operation as in Example 1 above was carried out except that the air bubbles were fed into the washing tub continuously. As in the previous experiments, the degree of detergency was measured at a time interval of 2 minutes and plotted to obtain curve A3 as shown in FIG. 11. The degree of detergency measured at the end of washing operation was around 51%.

The above comparative results clearly demonstrate the superior performance of the improved washing machine of the present invention in terms of its washing efficiency in a reduced period of washing time.

Furthermore, the present invention may equally be applied to the rinsing mode, in addition to the normal washing mode set forth hereinabove. For example, a single batch of air bubbles can be supplied to the washing tub immediately before the pulsator begins to operate in the rinsing mode. As the rinsing operation proceeds, the air bubbles tend to remove &he odor source, i.e., the residual detergent left in the washed articles, consequently providing an unexpected deodorization effect. As a result, the level of odor lingering in the laundered articles is reduced to such an extent that the user can hardly sense it.

While the best mode and preferred embodiments of the invention have been described herein, variations and changes may be made without departing from the scope and spirit of the invention.

What is claimed is:

1. A washing machine which comprises:

a washer tub capable of containing a level of washing fluid;

a pulsator rotatably mounted on the bottom of said washer tub for creating a vortex flow within said washer tub;

means for causing said pulsator to rotate in a foward or reverse direction; and means for supplying a predetermined amount of air bubbles into said washer tub in a batchwise manner at such a time interval as to allow said amount of air bubbles supplied in a given batch to be substantially collapsed before a next supply of said air bubbles commences, wherein said bubble supply means includes an air pump for producing a volume of pressurized air, a bubble generator associated with said air pump for converting the pressurized air into Said air bubbles, and means for controlling the operation of said air pump so that no air bubbles may be supplied until said amount of air bubbles supplied in a preceding batch is substantially collapsed.

2. The washing machine of claim 1, wherein said control means comprises:

means for generating a series of signals including a level signal indicative of the level of the washing fluid contained in the washer tub and a load signal indicative of the weight of the laundry articles contained in the washer tub;

microprocessor means responsive to the level and the load signals for selecting a predetermined amount of air bubbles and alternately generating an injection control signal for an injection time period wherein said predetermined amount of air bubbles is supplied into the washer tub and a collapsing control signal for a collapsing time period wherein said predetermined amount of air bubbles supplied into the washer tub is substantially collapsed; and air pump drive means responsive to the injection control signal for energizing the air pump and responsive to the collapsing control signal for deenergizing the airpump.

3. A washing machine of claim 2, wherein said predetermined amount of air bubbles, y*, is determined by the equation:

$$y^* = \beta - \alpha x$$

wherein $\alpha$ is a coefficient of bubble supply, $\beta$ is a reference bubble quantity with respect to a given volume of the washing fluid, and x is the weight of the laundry articles.

4. A washing machine of claim wherein said coefficient of bubble supply, $\alpha$, ranges from 0.55 to 0.68 and said reference bubble quantity, $\beta$, is equal to one tenth of the volume of the washing fluid.

5. A washing machine of claim 4, wherein said collapsing time period is equal to or greater than the injection time period.

6. A washing machine of claim 4, wherein said generating means includes a switch station for generating the level signal and a load sensor for detecting the weight of the laundry articles to generate the load signal.

7. The washing machine of claim 1, wherein said bubble generator includes a casing having an inlet and an outlet ports, a porous member housed within said casing to provide an interface between the pressurized air and the washing fluid, a bubble orientation plate mounted on the outlet port of said casing, said plate having a plurality o±bubble communication holes, and a flap valve for closing off said bubble communication holes when the bubble generator does not emit said air bubbles.

8. The washing machine of claim 1, wherein said pulsator is provided with a plurality of axial through-holes pierced through the thickness of said pulsator and a plurality of radial grooves formed on the peripheral underside of said pulsator, and wherein said washer tub has on its side wall a bubble impinging surface for directing said air bubbles radially upward within said washer tub.

* * * * *